US010020179B2

(12) United States Patent
Jiang et al.

(10) Patent No.: US 10,020,179 B2
(45) Date of Patent: Jul. 10, 2018

(54) FOCUSING ION GUIDING APPARATUS AND MASS SPECTROGRAPHIC ANALYSIS APPARATUS

(71) Applicant: SHIMADZU CORPORATION, Kyoto-shi, Kyoto (JP)

(72) Inventors: Gongyu Jiang, Shanghai (CN); Jiaqi Shen, Shanghai (CN); Wenjian Sun, Shanghai (CN)

(73) Assignee: SHIMADZU CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 15/511,561

(22) PCT Filed: Nov. 19, 2015

(86) PCT No.: PCT/CN2015/095000
§ 371 (c)(1),
(2) Date: Mar. 15, 2017

(87) PCT Pub. No.: WO2016/078602
PCT Pub. Date: May 26, 2016

(65) Prior Publication Data

US 2017/0256387 A1 Sep. 7, 2017

(30) Foreign Application Priority Data

Nov. 19, 2014 (CN) ..... 2014 1 0664533

(51) Int. Cl.
*H01J 49/06* (2006.01)
*H01J 49/36* (2006.01)

(52) U.S. Cl.
CPC ..... *H01J 49/063* (2013.01); *H01J 49/067* (2013.01); *H01J 49/36* (2013.01)

(58) Field of Classification Search
CPC ..... H01J 49/062; H01J 49/063; H01J 49/065; H01J 49/066; H01J 49/36
See application file for complete search history.

(56) References Cited

U.S. PATENT DOCUMENTS 6,646,258 B2 11/2003 Russ, IV
7,982,183 B2 7/2011 Makarov et al.
(Continued)

FOREIGN PATENT DOCUMENTS

CN 101022076 A 8/2007
WO 2014001827 A2 1/2014

OTHER PUBLICATIONS

International Search Report (ISR) issued by the State Intellectual Property Office of the Peoples Republic of China dated Feb. 3, 2016 for PCT/CN2015/095000, China.

*Primary Examiner* — Wyatt Stoffa
*Assistant Examiner* — Eliza Osenbaugh-Stewar
(74) *Attorney, Agent, or Firm* — Tim Tingkang Xia, Esq.; Locke Lord LLP

(57) ABSTRACT

A focusing ion guiding apparatus includes: at least one ion guiding inlet and ion guiding outlet connected to each other via a transport axial line; at least one group of focusing electrode structures comprising at least one smooth and non-concave focusing electrode or focusing electrode array to which a focusing voltage is applied, the focusing electrode structure causing the ions transported in the apparatus to be radially focused for many times under the action of a focusing electric field formed by the focusing electrode structure; and a neutral gas flow transported in the axial direction, a diffusion path of the gas flow in an at least partially radial direction relative to the axial direction being blocked by the focusing electrode or its bearing substrate to increase a transport velocity of the gas flow in the axial
(Continued)

direction and reduce retention or turbulence of the transported ions.

14 Claims, 5 Drawing Sheets

(56) References Cited

U.S. PATENT DOCUMENTS

| | | | | |
|---|---|---|---|---|
| 8,148,679 | B2 | 4/2012 | Makarov et al. | |
| 8,642,949 | B2 | 2/2014 | Makarov et al. | |
| 2011/0049356 | A1* | 3/2011 | Fernandez De La Mora | H01J 49/062 250/283 |
| 2012/0261570 | A1* | 10/2012 | Shvartsburg | H01J 49/0018 250/287 |
| 2014/0151546 | A1* | 6/2014 | Li | H01J 49/062 250/282 |
| 2015/0228467 | A1* | 8/2015 | Grinfeld | H01J 49/0018 250/396 R |

* cited by examiner

FOCUSING ION GUIDING APPARATUS AND MASS SPECTROGRAPHIC ANALYSIS APPARATUS

FIELD OF THE INVENTION

The present invention relates to the field of ion guiding technologies, and particularly to a focusing ion guiding apparatus and a mass spectrographic analysis apparatus.

BACKGROUND OF THE INVENTION

Generally, there is a need for various ion guiding apparatuses for transporting ions between regions having different air pressures in mass spectrometry systems, Particularly, in a mass spectrometry system having an atmospheric pressure or near-atmospheric pressure interface, there is generally a background air pressure difference of more than 7 orders of magnitude between the ion interface and a mass analyzer, which brings difficulties to effective transport of ions between the regions having different air pressures. In the traditional mass spectrometry system design, a commonly adopted scheme is to use multi-stage differential cavities, wherein differential cavities at each stage are separated by flow limiting orifices, and the air pressure is substantially evenly distributed in the cavities at each stage, at which point conducting focusing lenses or multistage radio frequency ion guide will generally be provided in these cavities to confine the emission of ions when passing through these differential cavities, such that the ion transport air pressures can satisfy the working requirements of these ion conducting structures in combination with corresponding differential pumps, thereby effectively achieving the transport of ions to the regions of the mass analyzer and ensuring the sensitivity requirement of the mass spectrographic analysis of samples.

However, since the overall sensitivity of the mass spectrometry system needs to be ensured, it is not possible for the flow conductance of the flow limiting orifice to be too small. Generally, since ion beams are in high pressure regions greater than 100 Pa, i.e., diffusion is relatively severe in the regions pumped by rough vacuum pumps, the ion beams are typically difficult to be compressed to have diameters less than 1 mm. To avoid the loss of ion transport efficiency, the air pressure difference of ions from a rough vacuum section to a high vacuum section generally does not exceed 2 orders of magnitude. Even so, a molecular pump or diffusion pump having a pumping rate of more than 100 L/s must be arranged in this transitional vacuum region. In addition, a high vacuum pump having a similar pumping rate is also required in the region of the mass analyzer, such that the cost of the mass spectrometry system having the near-atmospheric pressure interfaces is greatly limited by the high vacuum pump with high price and large volume, and the spectrographic analysis apparatus is difficult to be made small and exquisite.

Another difficulty with ion transport under the transitional vacuum air pressure is too high ion cooling speed. That is, when ions are transported at a background air pressure greater than 10 Pa, their original kinetic energies or electric field accelerating kinetic energies obtained in a transport system will be taken away quickly due to a large number of collisions between surrounding gas molecules having heat movement speeds. Therefore, the dwell time of the ions in these ion guiding apparatuses is generally very long. Particularly for a continuously working pulse ion source-scanning mass spectrometry system or a quasi-continuously working large-mass-range high-speed time-of-flight mass spectrometry system, long dwell time means that a large proportion of the ions cannot reach a detector under their correct ion mass-to-charge ratio channel conditions, thereby affecting the sensitivity of the mass spectrometer. Meanwhile, the ions reaching the detector at inappropriate time may also cause adverse effects such as cross contamination, space charge effect, etc., further deteriorate the performance of mass spectrometers.

Generally, in order to solve these problems, during the focusing and confining of ions, other means need to be adopted to confine the divergence of the ions in the space and to reduce the flow conductance of the background gas between the differential cavities; meanwhile, the transport speed of the ions in the axial direction needs to be increased. Such problems have been recognized in some studies in the prior art. For example, in U.S. Pat. No. 7,982,183, it has been considered to replace the traditional flow limiting orifices with capillary round tube structures in order to form better flow limiting structures between stages. However, this scheme does not involve the prevention of the transport of ions in these capillary tubes from diffusion loss. Therefore, a higher ion transport rate cannot be achieved in such practical application. In addition, some other structures, such as radio frequency focused ion guides involved in U.S. Pat. Nos. 8,148,679 and 8,642,949 are used to confine the ions. However, these ion guides all have open-ended lateral openings, and cannot cause the movement of gas flows in the guiding apparatuses to be confined significantly. The dwell loss during ion transport will generally be solved by axially applying a DC voltage or a DC traveling wave. However, the introduction of the axial DC voltage requires introduction of a field adjusting electrode or a design in which focusing electrodes are separated to form sections, which not only increases superfluous electronic design but also increases the system power consumption, and lowers ion guiding stability.

Agilent has proposed in U.S. Pat. No. 6,646,258 a method for confining ions by a quadrupole confining field formed through applying radio frequency to a concave focusing electrode attached in a pipe. Similarly, in the International Patent Application WO2014001827, Fasmatech has also proposed a similar flow conducting duct internally provided with a jet stream by a plurality of superposed annular electrodes, wherein effective radio frequency confinement may also be formed because a reverse radio frequency voltage is applied to the adjacent annular electrodes. However, such designs, when the gas flow conductance is further confined by reducing the pipe diameter, may all have some difficulties in structural design. For example, a pseudo potential of the concave electrode in its concave direction is apt to become a negative value, such that ions diffusing nearby the concave surface suffer a loss. In addition, an inner-wall electrode having an extremely small pipe diameter (for example, less than 2 mm) is very difficult in processing, and when a pipe channel is formed by using a superposition method, the inner wall of the pipe cannot be made smooth, thus the ions around the wall surface are easily lost due to turbulence.

SUMMARY OF THE INVENTION

In view of the above disadvantages in the prior art, an objective of the present invention is to develop a focusing ion guiding apparatus which confines gas flow transport and effectively conduces to ion transport, so as to resolve turbulence and ion detention loss caused by the abrupt decrease in gas flow velocity due to a direct obstacle or the like in the ion guiding process in the prior art.

In order to achieve the above and other relevant objectives, the present invention provides a focusing ion guiding apparatus comprising: at least one ion guiding inlet and ion guiding outlet connected to each other via a transport axial line, ions being transported in an axial direction along the transport axial line; at least one group of focusing electrode structures comprising at least one smooth and non-concave focusing electrode or focusing electrode array to which a focusing voltage is applied, the focusing electrode or focusing electrode array being arranged along the transport axial line, and the focusing electrode structures causing the ions transported in the focusing ion guiding apparatus to be radially focused for many times under the action of a focusing electric field formed by the focusing electrode structure; and a neutral gas flow transported in the axial direction, a diffusion path of the gas flow in an at least partially radial direction relative to the axial direction being blocked by the focusing electrode or its bearing substrate to increase a transport velocity of the gas flow in the axial direction and reduce retention or turbulence of the transported ions.

Optionally, surfaces of the smooth and non-concave focusing electrode and its bearing substrate are planes.

Optionally, over a preset length running along the axial direction with a tail end being the ion guiding outlet, the diffusion path of the neutral gas flow in the radial direction is completely blocked by the focusing electrode or its bearing substrate.

Optionally, the preset length is more than 50% of the total axial length.

Optionally, the radial blocking applied to the neutral gas flow by the focusing electrode or its bearing substrate accelerates an axial velocity of the gas flow and causes the axial velocity to increase or remain constant in a preset length running from the ion guiding inlet, the preset length being more than 50% of the total axial length.

Optionally, the focusing ion guiding apparatus is arranged in a first vacuum. chamber, and the tail end of the focusing ion guiding apparatus is hermetically connected to a second vacuum chamber, such that the pressure of the neutral gas flow traveling over at least one portion of the axial length in the focusing ion guiding apparatus changes between equilibrium pressures of the two chambers.

Optionally, the air pressure in the second vacuum chamber is lower than that in the first vacuum chamber; and the at least one portion of the axial length is more than 50% of the total axial length, and the air pressure in the portion of the axial length is lower than the air pressure in the first vacuum chamber.

Optionally, the focusing electrode structure comprises multiple groups of focusing electrodes and their bearing substrates; wherein gas flow diffusion paths at least in other radial directions substantially orthogonal to one radial direction are blocked by a group of focusing electrodes or their bearing substrates.

Optionally, the ion guiding apparatus is arranged in the first vacuum chamber, and at least one inner diameter decreasing section is formed in the first vacuum chamber along the axial direction, the minimum inner diameter of the inner diameter decreasing section being any of the following: A) 2-3 mm; B) 1-2 mm; and C) <1 mm.

Optionally, in the ion guiding process, the final velocity of the neutral gas flow accelerated over the preset continuous length is greater than any of the following: A) 5 m/s; B) 10 m/s, C) 20 m/s, D) 50 m/s, C) 100 m/s; and F) the sound velocity of the neutral gas flow under the current air pressure.

Optionally, the neutral gas flow is blocked in the at least partially axial direction via a tubular insulator or a highly resistance material body.

Optionally, the ion guiding apparatus comprises one or more gas flow inlets and gas flow outlets; and the focusing electrode structure is formed to comprise one or more combinations of a flow dividing structure communicating one gas flow inlet with a plurality of gas flow outlets, a flow converging structure communicating a plurality of gas flow inlets with one gas flow outlet, a curve-shaped gas flow groove communicating the gas flow inlets with the gas flow outlets via a curve and a multi-path parallel gas flow structure formed by communicating the gas flow inlets with the gas flow outlets one by one via straight lines.

Optionally, the focusing electrode structure is formed with an opening facing towards the ion guiding inlet serving as its preceding stage, an inner diameter of the opening being greater than a spatial inner diameter of the ion guiding apparatus over the preset length, or a radius of a focusing electric field at the opening being greater than a radius of a focusing electric field of the ion guiding apparatus over the preset length.

Optionally, spacings between the confining electrodes or spacings between the bearing substrates bearing different confining electrodes change along the axial direction, such that the neutral gas flow moving in the ion guiding process is periodically diverged and focused, such that the ions undergo multiple focusing processes based on a gas flow field formed by the neutral gas flow.

Optionally, the focusing ion guiding apparatus is arranged in the vacuum chamber; and a distance LA from a starting point of the preset length to the ion guiding inlet of the vacuum chamber is a. multiple of a Mach surface distance LM formed by the gas flow rushing into the ion guiding inlet, the multiple being one of the following: a) 0.5 to 0.8, b) 0.8 to 1, c) 1 to 1.2, d) 1.2 to 1.5, or e) 1.5 to 2.

Optionally, the electric field formed by the focusing electrode structure is one or more combinations of the following multipole fields: A) a quadrupole field; B) a hexapole field; C) an octupole field; D) an even multipole field higher than octupole; and E) an odd multipole field.

Optionally, the focusing electric field is a radio frequency focusing field or a periodical focusing field.

In order to achieve the above and other relevant objectives, the present invention further provides a mass spectrographic analysis apparatus comprising the focusing ion guiding apparatus as described.

As described above, the present invention provides a focusing ion guiding apparatus and a mass spectrographic analysis apparatus. The focusing ion guiding apparatus comprises: at least one ion guiding inlet and ion guiding outlet connected to each other via a transport axial line, ions being transported in an axial direction along the transport axial line; at least one group of focusing electrode structures comprising at least one smooth and non-concave focusing electrode or focusing electrode array to which a focusing voltage is applied, the focusing electrode or focusing electrode array being arranged along the transport axial line, and the focusing electrode structure causing the ions transported in the focusing ion guiding apparatus to be radially focused for many times under the action of a focusing electric field formed by the focusing electrode structure; and a neutral gas flow transported in the axial direction, a diffusion path of the gas flow in an at least partially radial direction relative to the axial direction being blocked by the focusing electrode or its bearing substrate to increase a transport velocity of the gas flow in the axial direction and reduce retention or turbulence of the transported ions. Moreover, the focusing ion guiding apparatus according to the present invention further provides additional flow conductance confinement on the neutral gas flow, thereby reducing the flow quantity of the passing neutral gas flow to decrease the pump system requirements of post-stage devices.

DETAILED DESCRIPTION OF THE INVENTION

Figure 1:
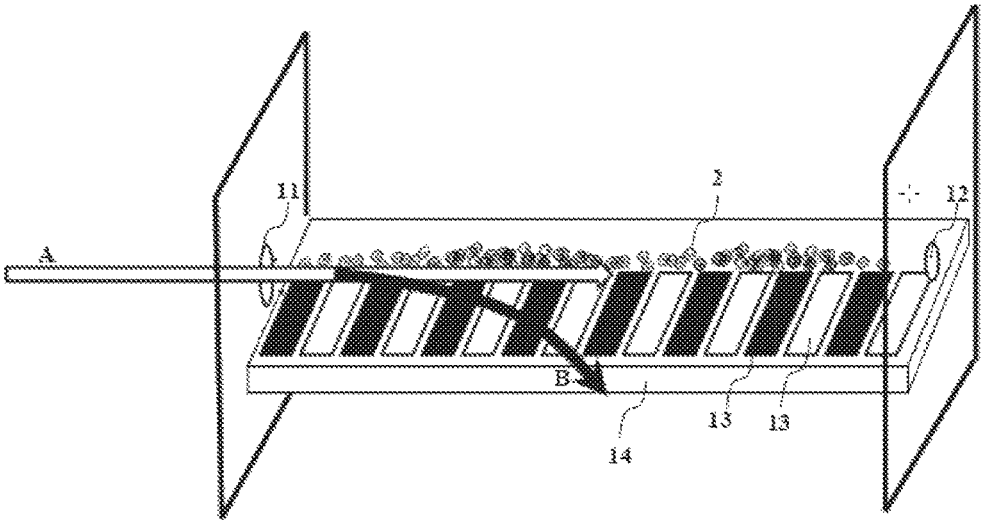
FIG. 1 is a schematic structural view illustrating a focusing ion guiding apparatus according to an embodiment of the present invention.

The embodiments of the present invention are described hereinafter with reference to specific examples. Those skilled in the art will readily understand and know the other advantages and effects of the present invention from the contents disclosed in the specification of the present invention. The present invention may also be practiced or applied through other different specific embodiments. Various details in the specification may also be modified or altered based on different standpoints and applications without departing from the spirit of the present invention. It should be noted that the embodiments and features in the embodiments of the present application can be combined with each other without conflict. As shown in FIG. 1, the present invention provides a focusing ion guiding apparatus comprising: an ion guiding inlet 11, an ion guiding outlet 12, and focusing electrode structures.

At least one ion guiding inlet 11 and ion guiding outlet 12 are connected to each other via a transport axial line, wherein ions 2 are transported in an axial direction along the transport axial line.

At least one group of focusing electrode structures comprise at least one smooth and non-concave focusing electrode 13 or focusing electrode array arranged along the transport axial line. Although the electrode array is shown in the figure, the invention is not limited thereto, and a single electrode may also be. In one embodiment, the focusing electrode may be an electrode of which one surface facing towards the transport axial line is a planar surface or a convex surface (preferably a planar shape), its bearing substrate 14 may be, for example, a PCB board, and the focusing electrode 13 may be a metal layer printed on the PCB board. A focusing voltage, which may be a radio frequency voltage or a periodical AC voltage, is applied to the focusing electrode 13. The radio frequency focusing field or periodical focusing field is formed after the focusing voltage is applied to the focusing electrode 13 or the focusing electrode array such that the focusing electrode 13 causes ions 2 transported in the focusing ion guiding apparatus to be radially (e.g. the direction B as shown) focused for many times under the action of the focusing electric field formed by the focusing electrode structure.

The neutral gas flow; which is transported in the axial direction, i.e., the direction as illustrated by the arrow A in the figure, is introduced to the focusing ion guiding apparatus. A diffusion path of the gas flow in an at least partially radial direction relative to the axial direction is blocked by the focusing electrode or its bearing substrate, i.e., as shown in the figure, the gas flow is blocked by the lower focusing electrode 13 or its bearing substrate 14. As such, the gas flow molecules can be prevented from escaping to continue moving axially, thereby increasing the transport velocity of the gas flow in the axial direction and reducing retention or turbulence of the transported ions 2.

Figure 2:
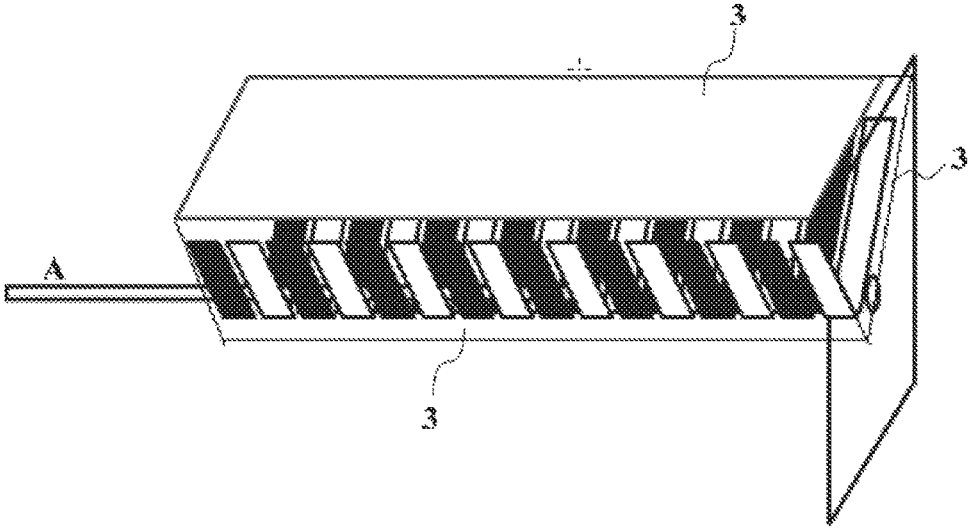
FIG. 2 is a schematic structural view illustrating a focusing ion guiding apparatus employing a plurality of electrode substrates to form an ion guiding structure according to an embodiment of the present invention.
Figure 3:
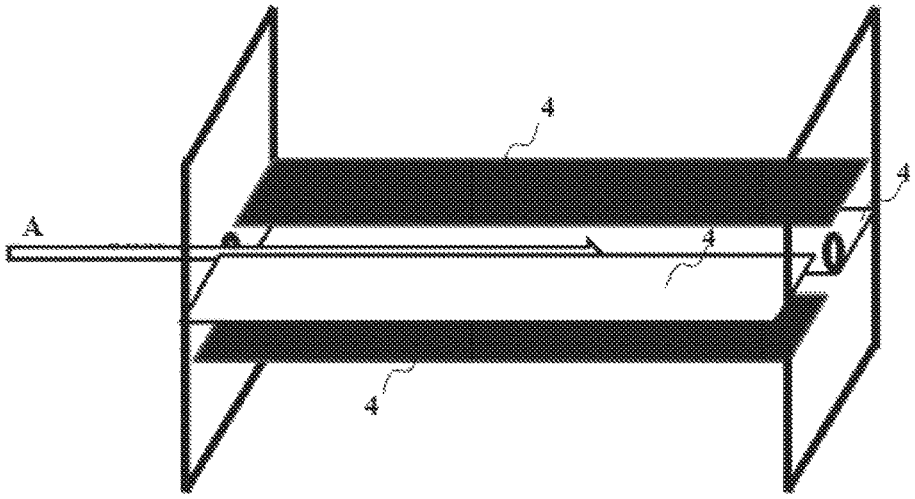
FIG. 3 is a schematic structural view illustrating a focusing ion guiding apparatus forming an ion guided quadrupole field according to an embodiment of the present invention.

In one embodiment, in order to further confine the flow conductance of gas towards the next stage, optionally, the focusing electrode may cause, over a preset length (for example, a portion or all of the axial length; in former case, preferably, the preset length is more than 50% of the total axial length) running along the axial direction with a tail end being the ion guiding outlet, the diffusion path of the neutral gas flow in the radial direction to be completely or partially blocked by the focusing electrode or its bearing substrate. That is, the bearing substrate, which may have a hollow tubular shape with a cross section in a triangle shape, a circle shape, a quadrangle shape or a polygon shape, serves as a flow limiting tube, and may be made from an insulating or highly resistance material for reducing charge accumulation (for example, a resin material of a PCB board). The gas flow axially passes though the hollow portion of the bearing substrate. Since the bearing substrate is sealed in the radial direction, the diffusion paths in the radial direction can be blocked totally. With reference to FIG. 2, three planar electrode substrates 3 are used to form an ion guiding structure to confine a gas flow. Of course, it may be a non-continuous structure, and may be designed to be a multi-piece spaced configuration or a hollow-carved configuration, i.e., the radial diffusion paths are only partially blocked. With reference to FIG. 3, four electrode substrates 4 are used, and the focusing electrodes on these four substrates 4 form a quadrupole electric field to focus and guide ions.

Figure 4:
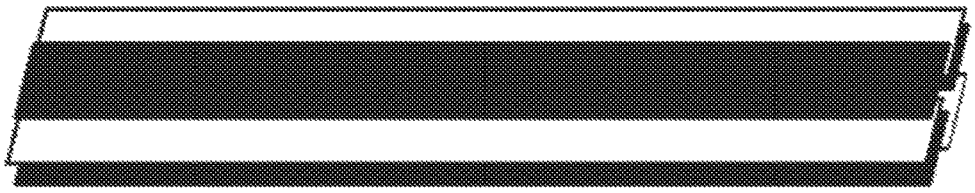
FIG. 4 is a schematic structural view illustrating a focusing ion guiding apparatus forming an ion guided hexapole field according to an embodiment of the present invention.
Figure 5:
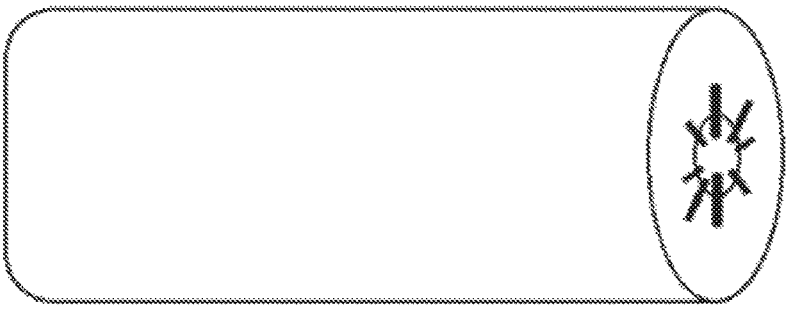
FIG. 5 is a schematic structural view illustrating a focusing ion guiding apparatus forming an ion guided octupole field according to an embodiment of the present invention.

In another embodiment, the electric field formed by the focusing electrode structure may be one or more combinations of the following multipole fields: A) a quadrupole field formed by the structure as shown in FIG. 3, B) a hexapole field formed by the structure as shown in FIG. 4, C) an octupole field formed by the structure as shown in FIG. 5, D) an even multipole field higher than octupole; and E) an odd multipole field. In addition, spacings between the confining electrodes or their bearing substrates may be changed along an axial direction in conjunction with an air dynamics scheme, such that the neutral gas flow in the ion guiding process is periodically diverged and focused, such that the ions undergo multiple focusing processes based on a gas flow field formed by the neutral gas flow.

In still another embodiment, since the flow conducting confinement may be changed by changing the size of a pipe through which the gas flow passes, in order to reduce the dwell loss of ions in such ion guiding process, the focusing electrode or its bearing substrate may be designed to apply a radial confinement on the neutral gas flow to cause the axial velocity of the gas flow to accelerate and increase or maintain constant (in the case of super-high vacuum) in the preset length running from the guiding inlet (because the radial movement is confined). Preferably, the preset length is equal to or more than 50% of the ion guiding axial length. In one embodiment, the focusing ion guiding apparatus is arranged in a first vacuum chamber, and the tail end of the focusing ion guiding apparatus is hermetically connected to a second vacuum chamber, such that the pressure of the neutral gas flow traveling over at least one portion of the axial length in the focusing ion guiding apparatus changes between equilibrium pressures of the two chambers. The air pressure in the second vacuum chamber is lower than that in the first vacuum chamber, such that the situation where the application. example is used for reducing the load of a pump system in a differential air pumping scheme is improved. For example, the at least one portion of the axial length is more than 50% of the total axial length, and the air pressure in the portion of the axial length is lower than the air pressure in the first vacuum chamber, such that the differential pump load in the first vacuum chamber will be reduced during the pressure reduction in the pipe, lowering the requirements on the pump and thus reducing cost. Preferably, in order to better compress the ion flow and confine the guiding transport of the gas flow, at least one inner diameter decreasing section may be formed in the first vacuum chamber along the axial direction, wherein the minimum inner diameter of the inner diameter decreasing section is any of the following: A) 2-3 mm; B) 1-2 mm; and C) <1 mm; and the inner diameter decreasing section may be a continuously contracted section (for example, horn-shaped) or a flat section (for example, stepwise).

In another embodiment, the focusing electrode structure comprises multiple groups of focusing electrodes and their bearing substrates; wherein gas flow diffusion paths at least in other radial directions substantially orthogonal to one radial direction are blocked by a group of focusing electrodes or their bearing substrates, i.e., direct diffusion paths of the neutral gas in a plurality of radial flat directions are completely blocked by the plurality of focusing electrodes and their bearing substrates respectively on the transport axial line of the ion guiding apparatus, such that the neural gas flow deviates from the ion guiding transport axial line. If the focusing ion guiding apparatus is in an open chamber, the load of the next-stage pump can be effectively reduced.

In one embodiment, in order to better increase the transport velocity of the ions in the ion guiding process, in the ion guiding process, the neural gas flow may be expanded and accelerated to a higher velocity in the blocked part by means of structural design. in the ion guiding process, the final velocity of the neutral gas flow accelerated in the preset length is greater than any of the following: A) 5 m/s; B) 10 m/s; C) 20 m/s; D) 50 m/s; E) 100 m/s; and F) the sound velocity of the neutral gas flow under this pressure condition to the extent that adiabatic ultrasonic expansion occurs.

Figure 6:
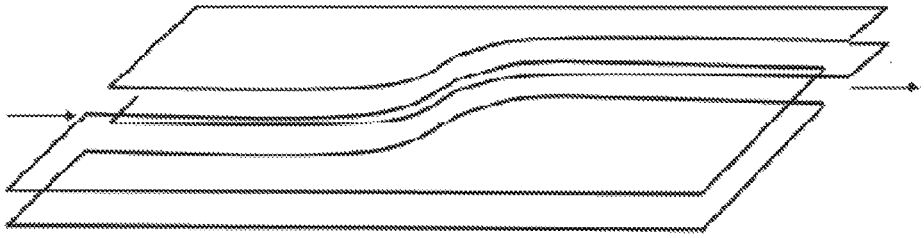
FIG. 6 is a schematic structural view illustrating a focusing ion guiding apparatus curvedly transporting gas flows and ions according to an embodiment of the present invention.
Figure 7:
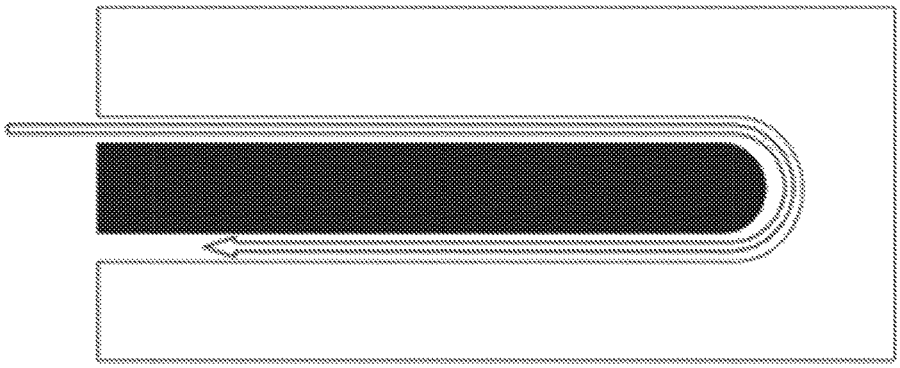
FIG. 7 is a schematic structural view illustrating a focusing ion guiding apparatus curvedly transporting gas flows and ions according to another embodiment of the present invention.

The ion guiding apparatus may comprise a plurality of gas flow inlets corresponding to the ion guiding inlets and a plurality of gas flow outlets corresponding to the ion guiding outlets, and the focusing electrode structure is formed in the following several manners, wherein the flowing directions of the gas flow may be the directions denoted by white arrows in the figures:

As shown in FIGS. 6 and 7, in order to reduce the actual ion guiding length, the gas flow and the ion flow therein may be folded or bent by a gas flow groove design, at which point the flowing direction of the neural gas flow is a curve-shaped gas flow groove communicating the gas flow inlet with the gas flow outlet via a curve.

Figure 8:
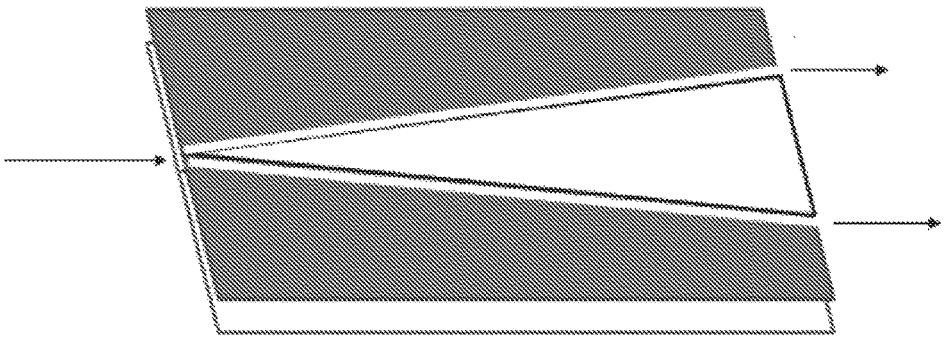
FIG. 8 is a schematic structural view illustrating a flow dividing structure of a focusing ion guiding apparatus for transporting gas flows and ions according to an embodiment of the present invention.
Figure 9:
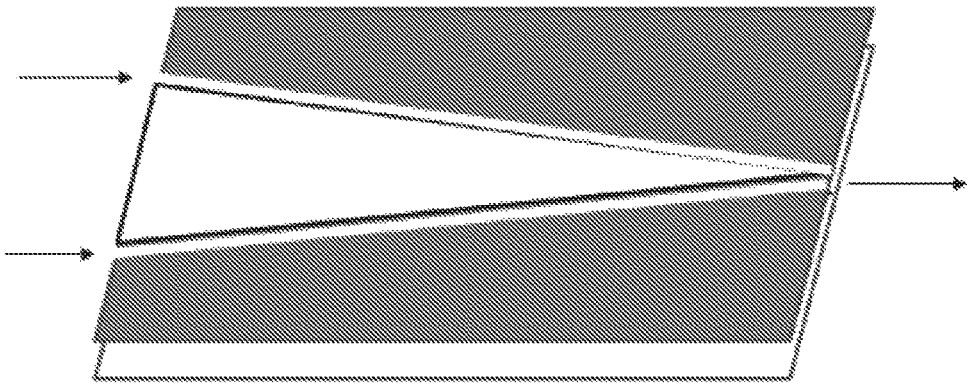
FIG. 9 is a schematic structural view illustrating a flow converging structure of a focusing ion guiding apparatus for transporting gas flows and ions according to an embodiment of the present invention.

As shown in FIGS. 8 and 9, in order to increase an ion capture area of the ion guiding apparatus, the ion guiding apparatus may comprise one or more gas flow inlets and gas flow outlets. Similarly, in order to reduce space charges at the inlets of the next-stage optical apparatus, a flow dividing structure communicating one gas flow inlet with a plurality of gas flow outlets and a flow converging structure communicating a plurality of gas flow inlets with one gas flow outlet may be formed.

Figure 10:
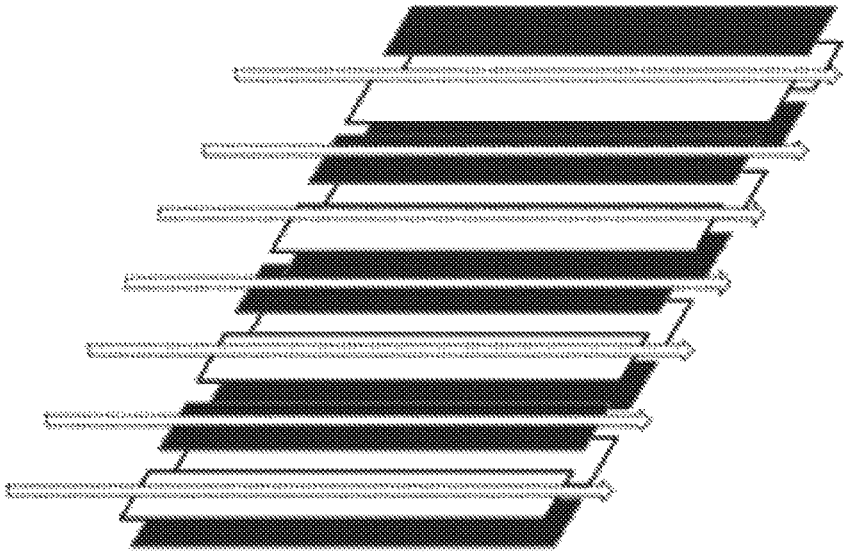
FIG. 10 is a schematic structural view illustrating parallel gas flow grooves of a focusing ion guiding apparatus for transporting gas flows and ions in multiple paths according to an embodiment of the present invention.

As shown in FIG. 10, when the apparatus has a plurality of next-stage ion analyzers or analysis channels, the ion guide apparatus may be arrayed. For example, a plurality of gas flow inlets and the same number of gas flow outlets may be designed in the ion guiding apparatus, and the focusing electrodes or their substrate structures may be altered to form a plurality of parallel gas flow grooves for passage of a plurality of parallel gas flows, as illustrated by white arrows in the figure.

Figure 11:
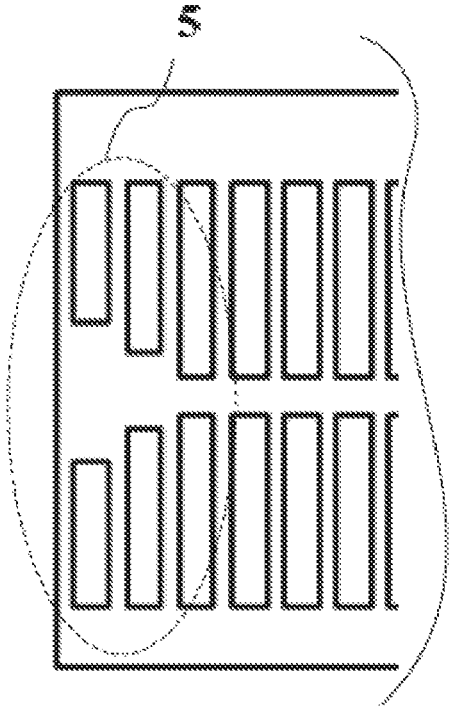
FIG. 11 is a schematic structural view illustrating an opening formed on a focusing electrode structure of a focusing ion guiding apparatus according to an embodiment of the present invention.

As shown in FIG. 11, in order to increase the ion capture area of the ion focusing guide apparatus, in the ion guiding scheme where a tubular apparatus has a narrow reception area, the focusing electrode structure can be formed with an opening 5 facing towards the ion guiding inlet serving as its preceding stage; and an inner diameter of the opening 5 is greater than a spatial inner diameter of the ion guiding apparatus in the preset length, or a radius of a focusing electric field at the opening 5 is greater than a radius of the focusing electric field of the ion guiding apparatus in the preset length. In principle, the opening 5 may be formed when spacings between the focusing electrodes or spacings between the bearing substrates bearing different confining electrodes changes along the axial direction. in a specific implementation, the formation of the opening can be realized by changing the electrode length as shown in the figure, such that the neutral gas flow moving in the ion guiding process is periodically diverged and focused, so that the ions undergo multiple focusing processes based on the gas flow field in the ion guiding process. It should be noted that, according to the principle as shown in FIG. 11, that the structure of the opening structure can be known to be formed by changing the bearing substrates. To ensure simplicity of the design, the focusing electrodes in the tubular section and the opening section may be fabricated on the same planar or convex electrode substrate and are separated by a flow limiting fin.

In one embodiment, as described above, the focusing ion guiding apparatus may be arranged in a vacuum chamber. In order to improve the gas stability over the ion transport path, the structure which is formed by tubular confinement and blocks the neural gas flow over the preset length running along the axial direction with a tail end being the ion guiding outlet needs to be inserted into a Mach surface formed by the gas flow at the ion guiding inlet. However, in consideration of the guiding or blocking effect caused by a smooth surface of the focusing electrode structure on transport of post-exit gas beams, a distance LA from a starting point of the preset length to the ion guiding inlet in the vacuum chamber is required to be set such that LA is a multiple of a Mach surface distance LM formed by the gas rushing into the ion guiding inlet, the multiple being one of the following: a) 0.5 to 0.8, b) 0.8 to 1, c) 1 to 1.2, d) 1.2 to 1.5, ore) 1.5 to 2.

The focusing ion guiding apparatus according to the present invention can be, as a component, applied to a mass spectrographic analysis apparatus, such as a mass spectrometer and the like.

In conclusion, the present invention provides a focusing ion guiding apparatus and a mass spectrographic analysis apparatus. The focusing ion guiding apparatus comprises: at least one ion guiding inlet and ion guiding outlet connected to each other via, a transport axial line, ions being transported in an axial direction along the transport axial line; at least one group of focusing electrode structures comprising at least one smooth and non-concave focusing electrode or focusing electrode array to which a focusing voltage is applied, the focusing electrode or focusing electrode array being arranged along the transport axial line, and the focusing electrode structure causing the ions transported in the focusing ion guiding apparatus to be radially focused for many times under the action of a focusing electric field formed by the focusing electrode structure; and a neutral gas flow transported in the axial direction, a diffusion path of the gas flow in an at least partially radial direction relative to the axial direction being blocked by the focusing electrode or its bearing substrate to increase a transport velocity of the gas flow in the axial direction and reduce retention or turbulence of the transported ions. Moreover, the focusing ion guiding apparatus according to the present invention further provides additional flow conductance confinement on the neutral gas flow, thereby reducing the flow quantity of the passing neutral gas flow to decrease the pump system requirements of post-stage devices.

The above embodiments are merely used for exemplarily illustrating the principles and effects of the present invention, and are not intended to limit the present invention. Any person skilled in the art can make modifications or variations to the above embodiments without departing from the spirit and scope of the present invention. Therefore, any equivalent modification or variation made by those ordinary skilled in the art without departing from the spirit and technical idea disclosed in the present invention should still be covered by the claims of the present invention.

The invention claimed is:

1. A focusing ion guiding apparatus, comprising:

at least one ion guiding inlet and ion guiding outlet connected to each other via a transport axial line, ions being transported in an axial direction along the transport axial line;

at least one group of focusing electrode structures comprising at least one smooth and non-concave focusing electrode or focusing electrode array to which a focusing voltage is applied, the focusing electrode or focusing electrode array being arranged along the transport axial line, and the focusing electrode structure causing the ions transported in the focusing ion guiding apparatus to be radially focused for many times under the action of a focusing electric field formed by the focusing electrode structure; and a neutral gas flow transported in the axial direction, a diffusion path of the gas flow in an at least partially radial direction relative to the axial direction being blocked by the focusing electrode or a bearing substrate thereof to increase a transport velocity of the gas flow in the axial direction and reduce retention or turbulence of the transported ions, wherein over a preset length running along the axial direction with a tail end being the ion guiding outlet, the diffusion path of the neutral gas flow in the radial direction is completely blocked by the focusing electrode or the bearing substrate thereof; and wherein the focusing ion guiding apparatus is arranged in a vacuum chamber; and a distance LA from a starting point of the preset length to the ion guiding inlet of the vacuum chamber is a multiple of a Mach surface distance LM formed by the gas flow rushing into the ion guiding inlet, the multiple being one of the following: a) 0.5 to 0.8, b) 0.8 to 1, c) 1 to 1.2, d) 1.2 to 1.5, or e) 1.5 to 2.

2. The focusing ion guiding apparatus according to claim 1, characterized in that surfaces of the smooth and non-concave focusing electrode and the bearing substrate thereof are planes.

3. The focusing ion guiding apparatus according to claim 1, characterized in that the preset length is more than 50% of the total axial length.

4. The focusing ion guiding apparatus according to claim 1, characterized in that the radial blocking applied to the neutral gas flow by the focusing electrode or the bearing substrate thereof accelerates an axial velocity of the gas flow and causes the axial velocity to increase or remain constant in a preset length running from the ion guiding inlet, the preset length being more than 50% of the total axial length.

5. The focusing ion guiding apparatus according to claim 4, characterized in that in the ion guiding process, the final velocity of the neutral gas flow accelerated over the preset continuous length is greater than any of the following: A) 5 m/s; B) 10 m/s; C) 20 m/s; D) 50 m/s; E) 100 m/s; and F) the sound velocity of the neutral gas flow under the pressure of the ion guiding inlet.

6. The focusing ion guiding apparatus according to claim 1, characterized in that the focusing electrode structure comprises multiple groups of focusing electrodes and bearing substrates thereof; wherein gas flow diffusion paths at least in other radial directions substantially orthogonal to one radial direction are blocked by a group of focusing electrodes or bearing substrates thereof.

7. The focusing ion guiding apparatus according to claim 1, characterized in that the ion guiding apparatus is arranged in the vacuum chamber, and at least one inner diameter decreasing section is formed in the vacuum chamber along the axial direction, and a minimum inner diameter of the inner diameter decreasing section being any of the following: A) 2-3 mm; B) 1-2 mm; and C) <1 mm.

8. The focusing ion guiding apparatus according to claim 1, characterized in that the neutral gas flow is blocked in the at least partially axial direction via a tubular insulator or an electrically resistant material body.

9. The focusing ion guiding apparatus according to claim 1, characterized in that the ion guiding apparatus comprises one or more gas flow inlets and gas flow outlets; and the focusing electrode structure is formed to comprise one or more combinations of a flow dividing structure communicating one gas flow inlet with a plurality of gas flow outlets, a flow converging structure communicating a plurality of gas flow inlets with one gas flow outlet, a curve-shaped gas flow channel communicating the gas flow inlet with the gas flow outlet via a curve and a multi-path parallel gas flow structure formed by communicating the gas flow inlets with the gas flow outlets one by one via straight lines.

10. he focusing ion guiding apparatus according to claim 1, characterized in that the focusing electrode structure is formed with an opening facing towards the ion guiding inlet serving as a preceding stage thereof, an inner diameter of the opening being greater than a spatial inner diameter of the ion guiding apparatus over the preset length, or a radius of a focusing electric field at the opening being greater than a radius of a focusing electric field of the ion guiding apparatus over the preset length.

11. The focusing ion guiding apparatus according to claim 10, characterized in that spacings between the confining electrodes or spacings between the bearing substrates bearing different confining electrodes changes along an axial direction, such that the neutral gas flow moving in the ion guiding process is periodically diverged and focused, such that the ions undergo multiple focusing processes based on a gas flow field formed by the neutral gas flow.

12. The focusing ion guiding apparatus according to claim 1, characterized in that the electric field formed by the focusing electrode structure is one or more combinations of the following multipole fields: A) a quadrupole field; B) a hexapole field; C) an octupole field; D) an even multipole field higher than octupole; and E) an odd multipole field.

13. The focusing ion guiding apparatus according to claim 1, characterized in that the focusing electric field is a radio frequency focusing field or a periodical focusing field.

14. A mass spectrographic analysis apparatus, comprising the focusing ion guiding apparatus according to claim 1.

* * * * *